US006098350A

United States Patent [19]

Kochtitzky

[11] Patent Number: 6,098,350

[45] Date of Patent: Aug. 8, 2000

[54] CRYPT FORM AND LINER FOR A MAUSOLEUM

[76] Inventor: John Kochtitzky, 5207 Suffolk Cir., Jackson, Miss. 39211

[21] Appl. No.: 09/203,411

[22] Filed: Dec. 2, 1998

[51] Int. Cl.[7] ..... E04H 13/00

[52] U.S. Cl. ..... 52/136; 52/79.9; 52/236.3; 52/134; 52/578; 52/588.1; 52/604

[58] Field of Search ..... 52/134, 136, 79.9, 52/236.3, 236.5, 588.1, 578, 604; 27/1, 29

[56] References Cited

U.S. PATENT DOCUMENTS

| | | | |
|---|---|---|---|
| 3,398,287 | 8/1968 | Gaucherd . | |
| 3,878,656 | 4/1975 | Duwe et al. . | |
| 3,986,308 | 10/1976 | Jones . | |
| 4,034,956 | 7/1977 | Gates . | |
| 4,048,772 | 9/1977 | Gaul | 52/136 |
| 4,073,100 | 2/1978 | DiGiovanni . | |
| 4,099,353 | 7/1978 | Blunt . | |
| 4,132,046 | 1/1979 | Duwe et al. . | |
| 4,277,924 | 7/1981 | Chimentin | 52/136 |
| 4,989,382 | 2/1991 | Spronken | 52/134 X |
| 5,243,794 | 9/1993 | Pikor | 52/136 |
| 5,408,787 | 4/1995 | Barnett . | |
| 5,899,045 | 5/1999 | Giannarelli | 52/134 X |

*Primary Examiner*—Robert Canfield
*Attorney, Agent, or Firm*—Polster, Lieder, Woodruff & Lucchesi

[57] ABSTRACT

A thin-walled, light weight crypt form/liner is provided for use in making monolithic mausoleums. The crypt form/liner includes a first side, a second side, and a top defining an open-ended chamber having a front edge. The top, first side, and second side of the form/liner can be pleated. A two tier frame is formed on the front edge to facilitate interconnection of adjacent form/liners. The second tier of one form/liner overlies the first tier of an adjacent form/liner. The two tiers include bolt holes which are aligned when the form/liners are positioned adjacent each other. A connecting rod is mounted to one of the form/liners, and is sized to extend through the bolt holes of both adjacent form/liners to extend beyond the front edges thereof. The front frames define a shoulder which surrounds the opening to the crypts. A sealer plate is mounted in the shoulder. A memorialization plaque is mounted on the connecting bars.

19 Claims, 6 Drawing Sheets

CRYPT FORM AND LINER FOR A MAUSOLEUM

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

This invention relates to monolithic mausolea and in particular, to a crypt form and liner used for making such mausolea.

Currently, mausolea are built from one of two methods: cast-in-place or pre-cast. Each has its advantages and disadvantages, and tend to be equivalent in cost. The mausolea built according to the cast-in-place method are monolithic and tend to be leak free. They are, however, labor intensive and time intensive to build, and the building process is subject to weather conditions. The pre-cast method is advantageous in that the crypts which will form the mausolea are manufactured off site. Their production is thus not subject to weather conditions. The pre-cast crypts are hauled to the site and placed on a foundation using a crane. Pre-cast mausolea thus can be built fairly quickly. However, the pre-cast crypts are quite heavy (on the order of 1800 lbs.), and long distance shipping is thus impractical. Also, specialized equipment is required to assemble the units on site. Further, once assembled, the mausoleum has seams between the crypts. These seams can be improperly sealed, which can lead to leakage of decomposition products and gasses.

BRIEF SUMMARY OF THE INVENTION

A crypt form and liner is provided for making a monolithic mausoleum. The form/liner operates initially as a form to form the crypts of a mausoleum. However, unlike prior forms, the form is not removed from the mausoleum after the mausoleum is complete. Rather, the form becomes an integral part of the mausoleum, and operates as a liner for the crypts after the mausoleum is constructed. The crypt form/liner includes a first side, a second side, and a top defining an open-ended chamber having a front edge. The top and first and second sides of the form/liner are pleated. The form/liner can be provided with one or more external ribs which extend the circumference of the form/liner generally perpendicular to the axis of the form/liner. The pleated walls can be used in conjunction with, or independently of, the ribbing on the form/liner walls. The pleating and the rib facilitate the use of thinner walls to reduce the weight of the form/liner without reducing the strength of the form/liner.

A two tier front frame is formed on the front edge of the form/liner. The first tier of the front frame includes a first side-member extending up the right front edge of the form/liner, a second side-member extending up the left front edge of the form/liner, and a cross-member extending between the first and second side members along the top of the front face. The second tier includes a side-member overlying the first tier left side member, and a cross-member overlying the first tier cross-member. The second tier side member extends outwardly beyond an outer edge of the first tier left side member to define a flange on the left side of the form/liner. The first and second tier members define an L-shaped shoulder extending up the left side of the form/liner and substantially across the top of the form/liner. The shoulder is formed along an inner edge of the side and top members of the first tier.

At least one bolt hole is formed in the second tier side member and a corresponding bolt hole is formed in the first tier right side member. The form/liner includes at least one connecting rod mounted on the right side of the form/liner. The connecting rod extends generally perpendicularly to the front edge of the form/liner and is sufficiently long to pass through the bolt holes of the first tier.

The crypt form/liner of the present invention is light weight and can be manufactured off-site as a pre-cast member or item which is shipped to the building site. Because of its light weight and small size, the crypt form/liner can be shipped long distances. The crypt form/liner may have a top and two sides which have wall thicknesses of about ⅛". The walls of the liner can be provided with ribs and/or pleats. The overall length of the form/liner is about 3.75 feet in length. These characteristics provide for a light weight form/liner without a reduction in strength. Because it is light weight, it can be shipped long distances. As well, the size of the form/liners allows crypts to be formed from a single form/liner, as for cremation urns, from two form/liners, as for a standard crypt, or any other number of form/liners for multiple interment vessels.

BRIEF DESCRIPTION OF THE SEVERAL VIEWS OF THE DRAWINGS

Corresponding reference numerals will be used throughout the several Figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 1:
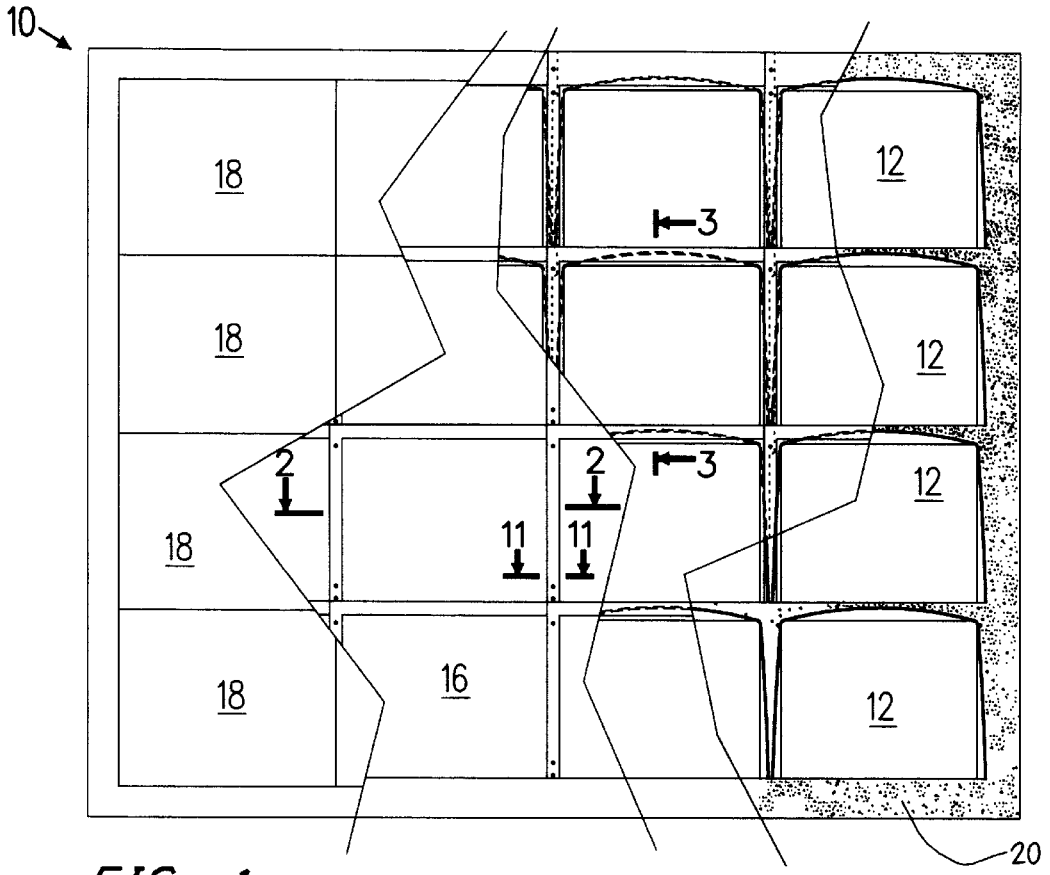
FIG. 1 is an elevational view, partially cut-away, of a mausoleum built with crypt form/liners of the present invention.

A mausoleum structure 10 is shown generally in FIG. 1. Although the mausoleum shown includes four rows, each formed by four spaces or crypts 12, the mausoleum can be made to any desired size. Each crypt is sealed with a front sealer plate 16 and a rear sealer plate 17. The front sealer plate is covered with a memorialization plaque 18. The rear sealer plate 17 connects the crypt 12 to a vent system V.

The mausoleum 10 is formed by first pouring a foundation 20 of concrete or other suitable material. A series of crypt form/liners 22 and 23 of the present invention are set on the foundation to form a first layer of crypts 12. The crypt form/liners are connected together and a rear sealer plate 17 is applied to the back of each form/liner, as will be discussed below. Concrete C is then poured around the form/liners to cast them in place. Once the concrete has set, a second layer of crypts can be assembled on top of the first layer. This process is continued until a mausoleum of a desired size is obtained.

Figure 2:
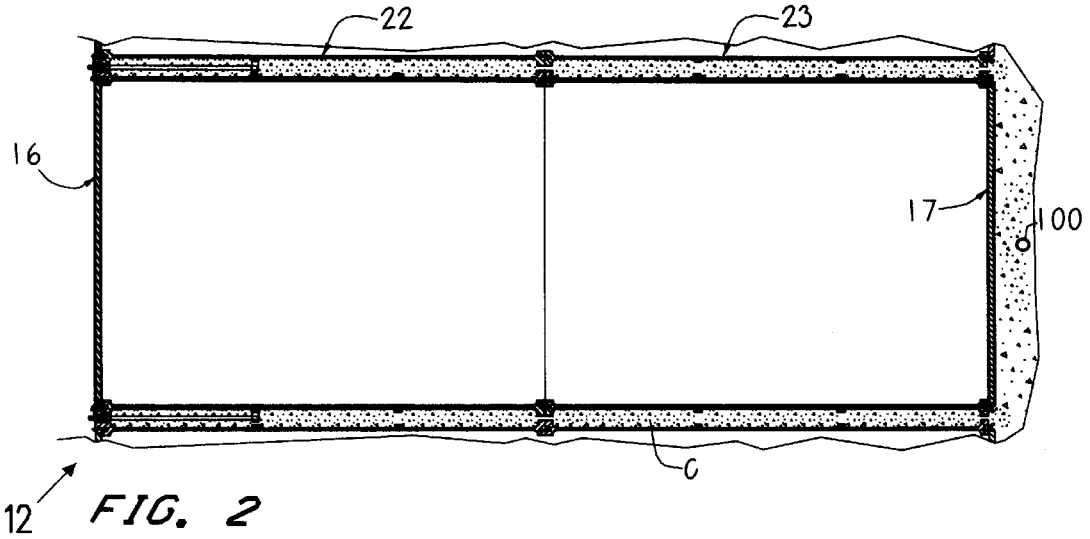
FIG. 2 is a cross-sectional view of a crypt in the mausoleum taken along line 2—2 of FIG. 1.
Figure 13:
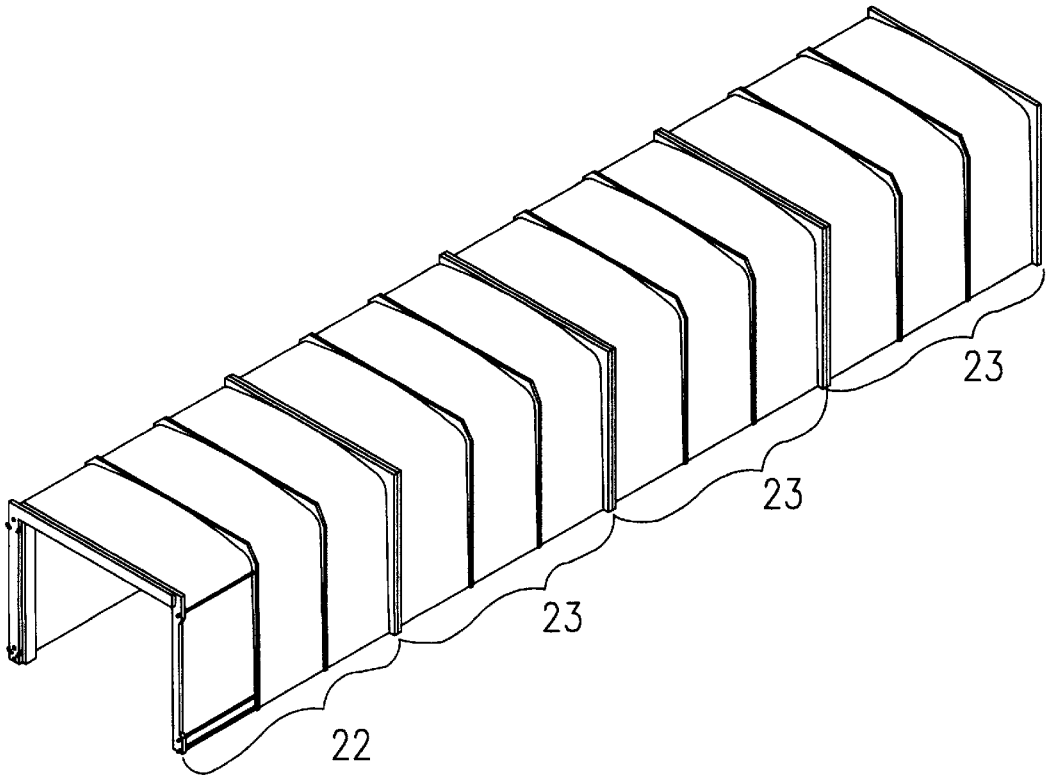
FIG. 13 is a perspective view of four crypt form/liners joined together to form a double crypt.

Each crypt 12 is actually made from two form/liners, a front form/liner 22 and one or more rear form/liners 23. FIG. 2 shows a crypt formed from a front form/liner 22 and a single rear form/liner 23. FIG. 13, on the other hand, shows a tandem crypt formed from a front form/liner 22 and three rear form/liners 23. The form/liners are pre-cast from a material such as, concrete with a fibrous filler providing for a thin wall with a good strength. This forms a light-weight form/liner which may be shipped long distances inexpensively. Preferably, the concrete includes, by weight, about 21.6% water, 21.7% cement, 27.2% course aggregate (pea gravel) and 29.5% fine aggregate (sand). Thus, per cubic yard, the concrete mix includes about 971 lbs. water, 975 lbs. cement, 1223 lbs. coarse aggregate, and 1327 lbs. fine aggregate. In addition, about 2 lbs./yd$^3$ of long, collated, fibrillated polypropylene can be added to reinforce the concrete. Silica fume can also be used in proportion to the cement to further densify and strengthen the concrete mix. To facilitate the use of silica fume, a water reducing admixture, such as Eucon WR-75 available from Euclid Chemical Company of Cleveland, Ohio, Pozzolith 200N available from Master Builders of Cleveland, Ohio, or Plastocrete 160 available from Sika Chemical Corporation, is used. Alternately, a high range water reducing admixture (a superplasticizer, such as Eucon37 available from Euclid Chemical Company or Sikament available from Sika Chemical Company, can be used. In either case, the water reducing admixture should conform to ASTM C494, Type A, and should not contain more chloride ions than are present in municipal drinking water.

Additionally, an accelerator admixture can be added to the concrete mix to achieve a quicker set to the shell of the form/liner. The accelerator should be a non-corrosive, non-chloride accelerator, such as Accelguard 80 available from The Euclid Chemical Company or Darex Set Accelerator available from W. R. Grace. The accelerator should conform to ASTM C494, Type F or G, and should not contain more chloride ions than are present in municipal drinking water.

The use of light-weight form/liners avoids the need for heavy machinery to position the form/liners when forming the mausoleun. Each form/liner section 22 and 23 is approximately 3.75' in length, has a wall thickness of about ⅛", and weighs approximately 200 lbs. Because the form/liner sections are shorter and lighter than conventional pre-cast crypts, they can more easily be shipped longer distances. The form/liners 22 and 23 are sized such that when a front form/liner 22 and a rear form/liner 23 are connected in tandem, they will form a standard 7½' crypt. However, if a small crypt is desired, such as for a small child or an animal, the crypt can be formed from only the front form/liner 22.

Figure 7:
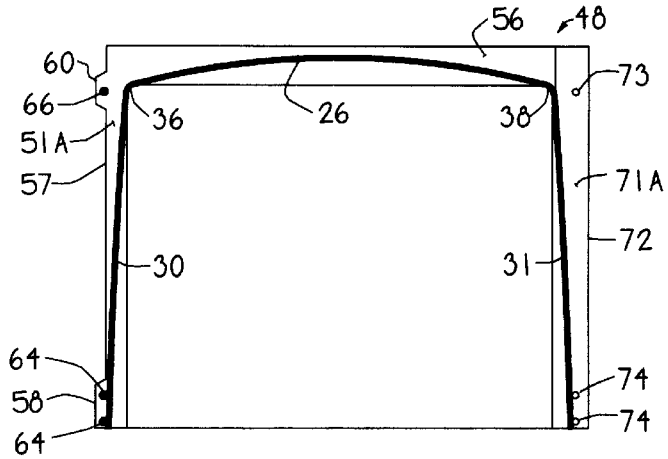
FIG. 7 is a cross-sectional view of the form/liner taken along line 7—7 of FIG. 3.
Figure 8:
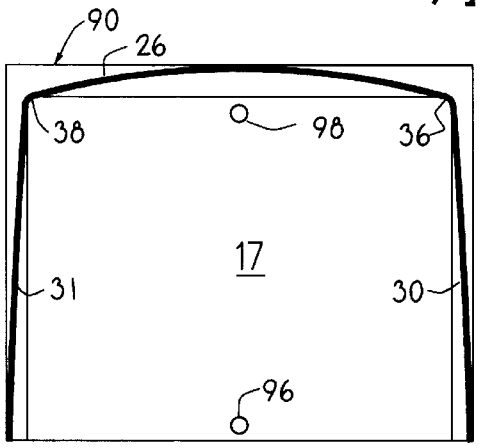
FIG. 8 is a cross-sectional view of the form/liner taken along line 8—8 of FIG. 3.
Figure 9:
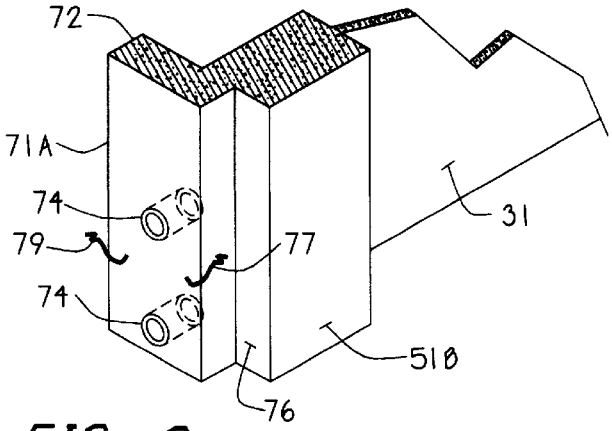
FIG. 9 is an enlarged fragmentary view of the bottom left front of the crypt form/liner taken along the circle 9—9 of FIG. 4.
Figure 10:
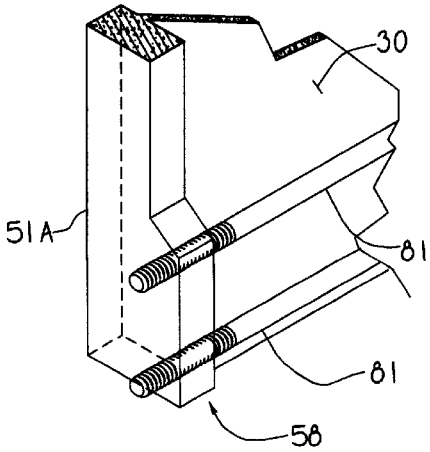
FIG. 10 is an enlarged fragmentary view of the bottom right front of the crypt form/liner taken along the circle 10—10 of FIG. 4.

The front form/liner 22 is shown in more detail in FIGS. 4–10. The front form/liner 22 comprises a top 26, a right side 30, and a left side 31 which form an open-ended, open-bottomed chamber. The top 26 and walls 30 and 31 are preferably smooth. The corners 36 and 38 (FIG. 7) formed by the sides and the top make a smooth, rounded transition between the sides and top. The top 26 has a slight arch (which is shown exaggerated in FIGS. 7 and 8). The sides are slightly short of vertical, as seen in FIG. 7, and slope inwardly from the bottom to the top. The walls, for example, have a thickness of about ⅛" and the form/liner section weighs about 200 pounds. The form/liner 22 is provided with ribs 40 which extend up the side walls 30 and 31 and across the top 26. The form/liner 22 is shown with two evenly spaced apart ribs 40, but more or fewer ribs could be used, as desired. The ribs increase the load bearing abilities of the form/liner and thus enable the form/liner to be made with thinner walls.

Figure 4:
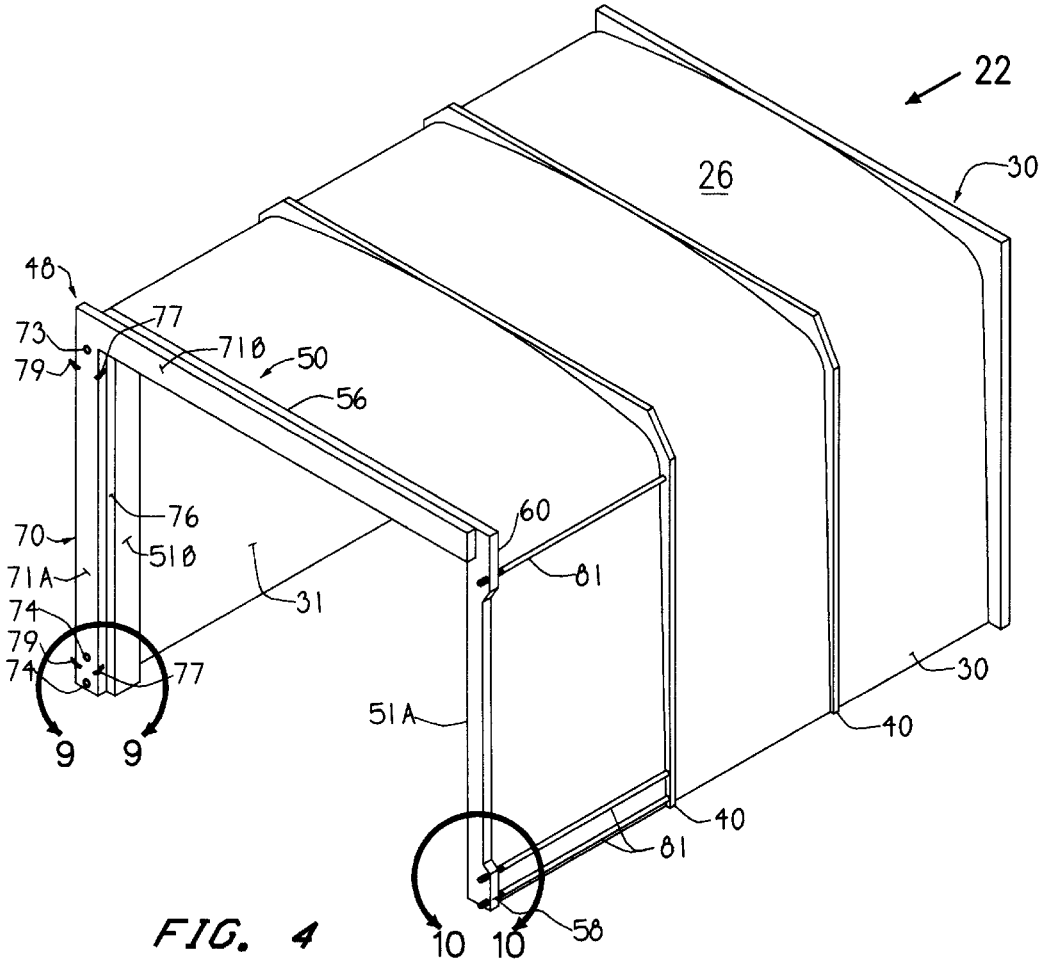
FIG. 4 is a perspective view of a crypt form/liner of the present invention.
Figure 5:
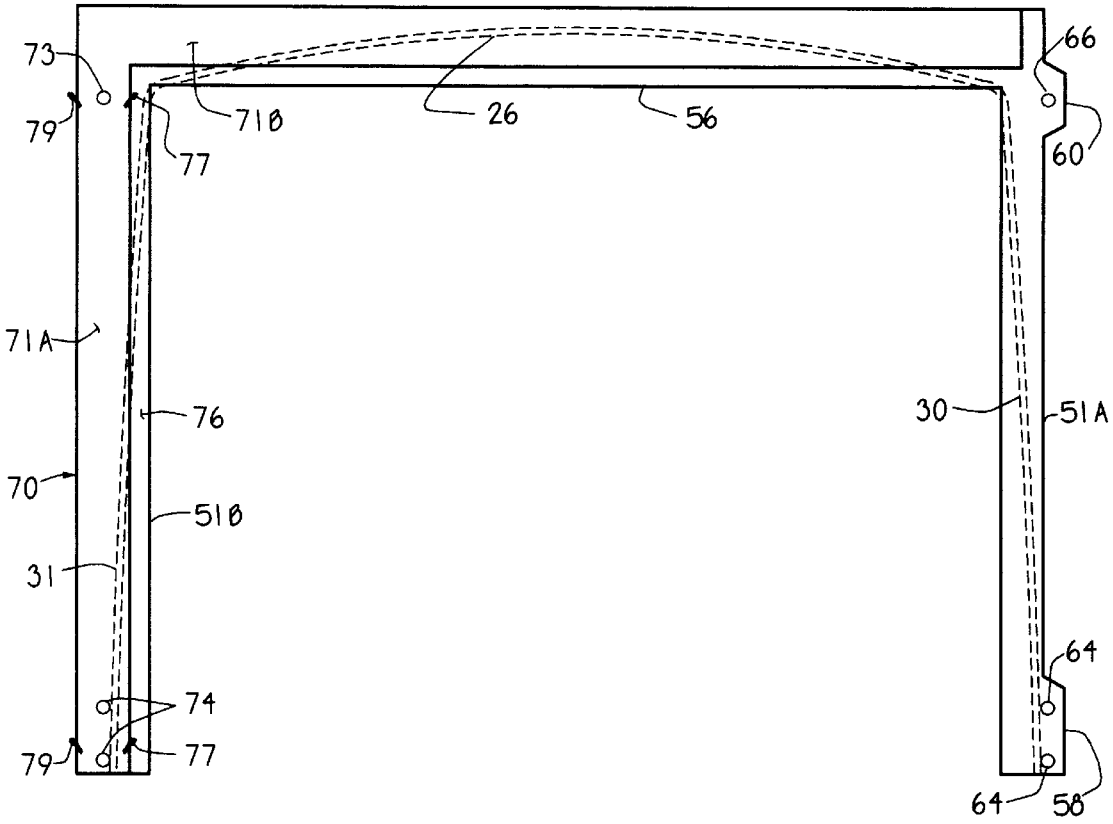
FIG. 5 is an enlarged front elevational view of the crypt form/liner.
Figure 6:
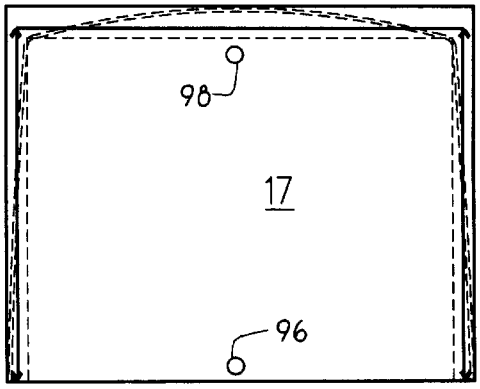
FIG. 6 is a rear elevational view of the crypt form/liner with a rear sealer plate in place on the form liner.

Referring now to FIG. 4, the front of the form/liner 22 has a two-tiered frame 48 which has a back surface (FIG. 7) extending outwardly from the walls and top of the form/liner 22. A first tier 50 includes side portions 51A and 51B which extend from the bottoms of the form/liner sides 30 and 31 to a short distance above the corners 36 and 38, and which forms right angles with a cross-piece 56. As best seen in FIG. 7, at least the right side portion 51A extends outwardly of the form/liner side wall 30 to form a right side flange 57. The top of the cross-piece 56 extends above the highest point of the top 26. The first tier 50 is generally uniform in width. A lower tab 58 integral with the first tier side portion 51A protrudes outwardly from the bottom of the first tier side portion 51A. An upper tab 60 integral with the first tier protrudes outward from the first tier at the top of the side portion 51A, as at 62. The lower tab 58 has two holes 64 and the upper tab 60 has a single hole 66. (FIG. 5).

Figure 11:
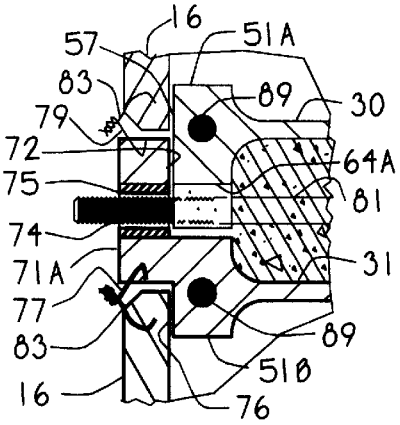
FIG. 11 is an enlarged fragmentary cross-sectional view taken along line 11—11 of FIG. 1 showing the connection of two adjacent form/liners and the mounting of a front sealer plate to the form/liners.

A second tier 70 is overlies the first tier 50, as can be seen in FIG. 4. The second tier 70 includes a side portion 71A extending upwardly from the bottom of the form/liner wall 31 to the top first tier cross-piece 56. The side portion 71A joins with a cross-piece 71B at the top of the form/liner. The side portion 71A is wider than the form/liner wall 31 and forms a left flange 72 (FIG. 7) extending outwardly from the wall. As seen in FIGS. 7 and 11, the side portion 71A extends outwardly beyond the side portion 51B of the first tier 50. The crosspiece 71B extends over the cross-piece 56 of the first tier 50. The tope edge of the cross-piece 71B is preferably flush with the top edge of the first tier cross-piece 56. The second tier 70 has a single bore hole 73 near the top of the side-piece 71A and a pair of bore holes 74 near the bottom of the side-piece 71A. The holes 74 can be lined with a grommet 75 (FIG. 11). Preferably, the second tier side member 71A and cross-member 71B are not flush with the inner edge of the first tier side member 51B and cross-member 56, to define a shoulder 76 which extends up the left side of the frame 48 and across the top of the frame 48. An upper and lower wire 77 are embedded in the second tier side member 71A near an inner edge of the side member 71A. A second set of upper and lower wires 79 are also embedded in the second tier side member 71A near an outer edge of the side member 71A.

Although described as two tiers, the frame 48 can be formed as a single piece which is either applied to the front edge of the form/liner 22, or preferably molded integrally with the form/liner 22. The frame 48 can be provided with an embedded rod 89 (FIG. 11) which extends around the frame to reinforce the frame.

The rear end of the form/liner section has a flangular frame 90 of generally uniform dimension, forming a squared, invented U shape. The frame 90 is preferably molded integrally with the form/liner 22. The height and width of the frame 90 are such that the outer edges of the frame 90 have the same outer dimensions as the two-tier frame 48 at the front of the form/liner 22. The rear frame 90 includes an embedded rod 91 similar to the embedded rod 89 in the front face 48 of the form/liner.

Referring to FIG. 11, when two form/liners 22 are place adjacent each other in side-by-side relationship, the left flange 72 of one form/liner 22 overlies the right flange 57 of the second adjacent form/liner 22, and the sides of the rear frames 90 of the two form/liners will be spaced slightly from each other, as seen in FIG. 2. The rear frame 90 could be sized so that the rear frame of neighboring form/liners are adjacent each other. When the form/liners are positioned in this side-by-side relationship, the outer edge of the second tier side member 71A will not extend the full width of the first tier side member 51A, as seen in FIG. 11. Thus, the two side members will cooperate to form a shoulder which will complete the shoulder 76 of the front frame 48. That is, there will be a shoulder of constant width which extends around the inner edge of the front frame (or around the opening to the crypt). The holes 73 and 74 of the second tier 70 are positioned to align with the bore holes 66 and 64 of the first tier 50, respectively. Again when placed in parallel, the second tier 70 matingly fits against and in front of the first tier 50.

The form/liner 22 includes connecting rods 81 on the outer surface of the form/liner right wall 30. Preferably, there are three rods 81; one at the top of the form/liner and two at the bottom of the form/liner. Further, the rods 81 are all preferably parallel to each other. The rods 81 have a back end which is fixed in the forward most rib 40 and are sized to extend through the holes 64 and 66 in the tabs 58 and 60. The forward ends of the rods 81 are threaded, and the threaded ends extend through the holes 64 and 66 of the form/liner 22 to which the rods 81 are mounted, as well as the holes 73 and 74 of the second form/liner. The rod 81 is of such a length such that the threaded end of the rod 81 extends beyond the front surface of the second tier side member 71A when the two adjacent form/liners are connected together.

Figure 14:
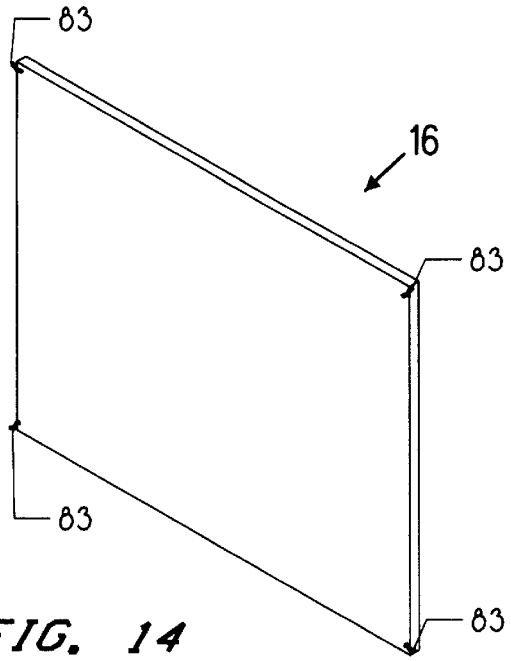
FIG. 14 is a perspective view of the front sealer plate.

To complete the front of the crypt 12, the sealer plate 16 is positioned on the shoulder 76 which extends around the opening of the crypt. The sealer plate 16 is provided with wires 83 at its four comers (FIG. 14). The sealer plate wires 83 are twisted together with the wires 77 and 79, as shown in FIG. 11, to hold the sealer plate in place over the crypt opening. A memorialization plaque 18 is then placed over the sealer plate. As noted above, the rods 81 extend past the front faces of the form/liners (and hence past the front sealer plates 16). Hanger brackets (not shown) are mounted to the threaded ends of the connecting rods. The memorialization plaques 18 are then mounted to the hanger brackets in any conventional manner.

Figure 12:
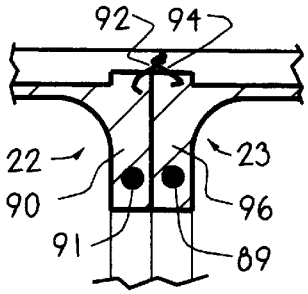
FIG. 12 is an enlarged fragmentary cross-sectional view taken along circle 12—12 of FIG. 3 showing the connection of two tandem crypt form/liners.

If a crypt 12 is to be formed from two form/liner segments to form a standard full-sized crypt, the crypt is formed with a front form/liner 22 and a rear or secondary form/liner 23. The secondary form/liners 23 are substantially identical to the front form/liners 22 and include side walls and a top wall which correspond in dimension and shape to the walls and top of the front form/liner 22. However, the front and back faces of the secondary form/liners 22 are identical to the back face or flange 90 of the front form/liner 22. As seen in FIG. 12, a wire 92 is embedded in the back face of the front form/liner 22 and a corresponding wire 94 is embedded in the front face 96 and back face of the secondary form/liner 23. The wires 92 and 94 are twisted together to position the form/liners in tandem. The wires need only be strong enough to prevent movement of the form/liners relative to each other while cement is being poured around the form/liners to set the form/liners in place. Once the cement has set, the cement will hold the form/liners in their relative positions. As shown in FIG. 13, several secondary form/liners may be positioned in tandem to produce even longer crypts. The crypt which would be formed from the four form/liners of FIG. 13 would be fifteen feet long, to allow two human caskets to be interred together in a single crypt.

The crypt form/liner sections may be placed so as to sit a slight measure into the foundation before solidification, or may be placed afterwards on top of the solid foundation. The foundation may, but need not, have protruding rebars (not shown) to facilitate alignment of the crypt form/liners in rows on the foundation.

Figure 3:
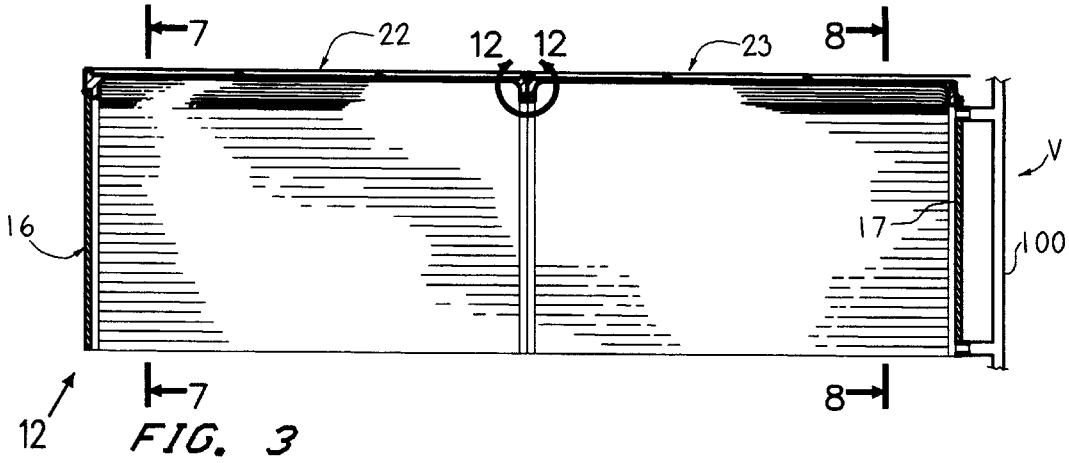
FIG. 3 is a cross-sectional view of a crypt in the mausoleum taken along line 3—3 of FIG. 1.

The back of the crypt is closed by the rear sealer plate 17. The rear sealer plate 17, like the front sealer plate 16, includes embedded wires. The rear plate 17 is simply pressed against the rear surface of the form/liners, and the wires are twisted together to hold the rear sealer plate to the back of the form/liners while the concrete is being poured. The rear plate 17 is provided with a drain hole 96 near its bottom, and a vent hole 98 near its top. The drain and vent holes are connected via piping 100 as seen in FIG. 3 to the vent system V to allow for decomposition gasses and fluids to escape from the crypt.

After the crypt form/liners are aligned in rows, interconnected, and closed at the back with a back sealer plate, as described above, each crypt 12 is formed by pouring concrete over the top 26 and between the sides 30, 31 of the crypt form/liners, forming an even or level top surface and leaving the front of the crypt open. Once the cement has set, a second layer of form/liners can be formed above the first layer. The cement which encases the first layer would provide the foundation for the second layer. Once the form/liners of the second layer are positioned and interconnected, and closed in the back with a rear sealer plate 17, the second layer of form/liners are encased in cement. The mausoleum is built up to a desired number of levels in this fashion to form a monolithic mausoleum. Encasement of the form/liners in cement ensures a proper seal between neighboring form/liners. As can be appreciated, each form/liner performs initially as a form around which the cement is poured to create the crypts. However, the form/liners are not removed, and once the cement has set, and the crypts are formed, the form/liners no longer function as forms, and function merely as form/liners. Thus, the form/liners 22 and 23 need only be strong enough to support themselves and the wet cement, until the cement sets.

Once the crypts are formed, the front sealer plates 16 and memorialization plaques 18 are applied to the open ends of the crypts as described above.

Figure 15:
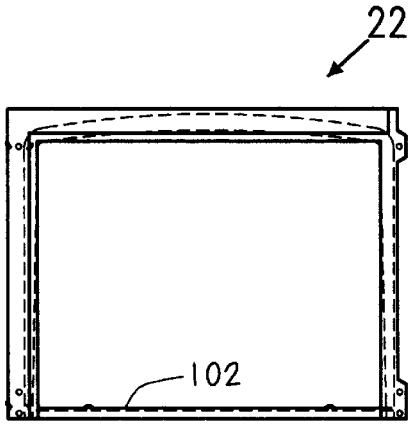
FIG. 15 is a front elevational view of the crypt form/liner provided with a bottom plate.

Turning to FIG. 15, a bottom plate 102 may be provided for use with the form/liners 22 and 23. A bottom plate 102 can be provided when certain features are desired which cannot be obtained from the cement foundation or the cement which forms the bed upon which the form/liners 22 and 23 are set. For example, a soft surface may be desired.

Figure 16:
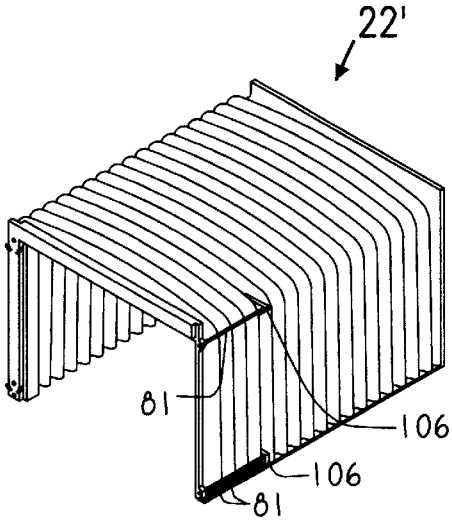
FIG. 16 is a perspective view of an alternative embodiment of the crypt form/liner.

A second embodiment 22' of the front form/liner is shown in FIG. 16. The form/liner 22' is substantially similar to the form/liner 22 of FIG. 4. However, the form/liner 22' does not include the ribs 40. Thus, to anchor the connecting rods 81, the form/liner 22' is provided with anchor cleats 106 in which the back ends of the rods 81 are anchored. In lieu of ribs, the walls of the form liner 22' are pleated or corrugated. The pleats extend generally parallel to each other and perpendicular to the central axis of the form/liner 22'. This pleated configuration increases the load bearing abilities of the form/liner 22' and, hence, allows the form liner 22' to be made with relatively thin walls.

Figure 17:
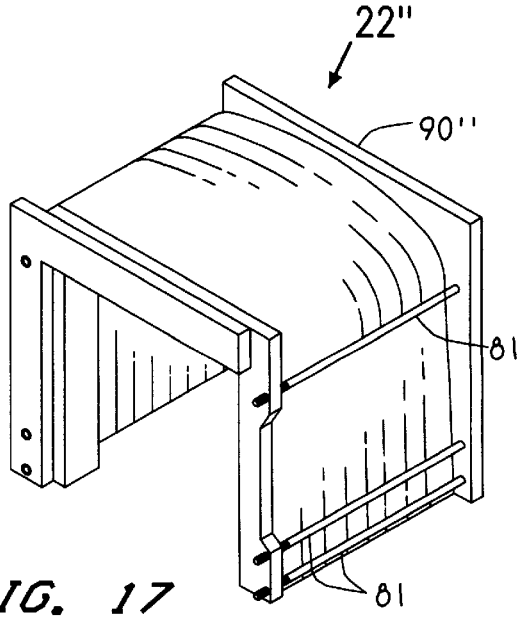
FIG. 17 is a perspective view of a second alternative embodiment of the crypt form/liner, this embodiment being sized for use as a niche unit.

A third embodiment 22" of the front form/liner is shown in FIG. 17. The form/liner 22" again is substantially similar to the form/liner 22' of FIG. 16. However, this form/liner is smaller, for example 12"×12"×12" and is designed for use as a niche unit. Because of the small size of the form/liner 22", the form/liner is not provided with the ribs 40 or the cleats 106. Rather, the connecting rods 81 extend forwardly from the back face 90", and the back ends of the rods 81 are embedded in the back face 90".

In view of the above, it will be seen that the several objects and advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense.

I claim:

1. A monolithic mausoleum comprising at least a first and a second crypt adjacent each other is a side-by-side relationship; said first and second crypts being identical and being formed from a form/liner with cement poured over and around the crypt form/liners;

each form/liner including:

a first side, a second side, and a top defining an open-ended chamber having a front edge;

a front frame on the front edge of each form/liner; the front frame having a first tier and a second tier; the first tier including a first side-member extending up the front edge of the first side of the form/liner, a second side-member extending up the front edge of the second side of the form/liner, and a cross-member extending between the first and second side members along the top edge of the form/liner; the second tier having a first side-member overlying the first tier second side member and a cross-member overlying the first tier cross-member; the first and second tiers defining a flange which extends up the front edge of the second side of the form/liner and across the front edge near the top of the form/liner, and a shoulder which extends up the second side of the form/liner and across the top of the form/liner;

the first tier first side member including at least one bolt hole and the second tier side member including at least one bolt hole;

connector bolts on an outer surface of the first side of the form/liner sized to extend through the first tier bolt hole and the second tier bolt hole of an adjacent form/liner;

the second tier of the first form/liner overlying the first tier of the second form/liner; the first and second tiers of the first and second form/liners defining a shoulder extending substantially around the opening of the second form/liner;

a front sealer plate sized to cover the opening to the form/liner; the sealer plate being seated on the shoulder surrounding the opening to the form/liner; and a rear sealer plate to close the back of the form/liner.

2. The mausoleum as described in claim 1 wherein the form/liner is pre-cast from concrete with a fibrous filler.

3. The mausoleum as described in claim 1 wherein the crypt is formed from a front form/liner and at least one secondary form/liner positioned in tandem relative to each other.

4. The mausoleum as described in claim 3 wherein the back sealer plate is applied to a last of the secondary form/liners.

5. The mausoleum as described in claim 3 wherein the form/liner includes a back edge and flexible wires extending from said back edge; said secondary form/liner including wires extending from forward edges thereof; said front form/liner wires and said secondary form/liner wires being twistable together to hold said form/liners in position relative to each other during the formation of said mausoleum.

6. The mausoleum as described in claim 1 wherein the connector bolts extend beyond the front frame of the form/liners to facilitate the mounting of memorialization plaques over the front sealer plates.

7. The mausoleum as described in claim 1 wherein the form/liners include flexible wires extending from their front frame and said front sealer plates include flexible wires extending therefrom; the form/liner wires and sealer plate wires being twistable together to mount the sealer plate over the opening of the opening of the crypt.

8. A crypt form/liner for making a monolithic mausoleum; the crypt form/liner comprising:

a first side, a second side, and a top defining an open-ended chamber having a front edge;

a front frame on the form/liner having a first tier and a second tier, the first tier including a first side-member extending up the front edge of the first side of the form/liner, a second side-member extending up the front edge of the second side of the form/liner, and a cross-member extending between the first and second side members along the top of the front frame; the second tier having a first side-member overlying the second side member of the first tier, and a cross-member overlying the cross-member of the first tier; the second tier side member extending outwardly beyond an outer edge of the first tier second side member; the first and second tier members cooperating to define a shoulder extending up an inner edge of the second side of the form/liner and substantially across the inner edge of the cross-members;

at least one bolt hole in the side member of the second tier and at least one bolt hole in the first side member of the first tier, the holes of the first and second tier being positioned so to aligned with holes of adjacent form/liners when, form/liners are positioned adjacent each other in a side-by-side relationship; and at least one connecting rod mounted on the first side of the form/liner and extending generally perpendicularly to the front edge of the form/liner; the connecting rod being sufficiently long to pass through the at least one bolt hole of the first tier.

9. A crypt formed by at least two form/liners of claim 1 joined in tandem.

10. The crypt as described in claim 9 wherein the one of the two form/liners is a front form/liner and the other of the two form/liners is a secondary form/liner.

11. The crypt as described in claim 10 wherein the front form/liner has a back frame and the secondary form/liner has front and back frames corresponding to the back frame of the front form/liner; the front frame of the secondary form/liner abutting back frame of the front form/liner.

12. The crypt of claim 11 wherein the front form/liner includes wires extending from its back frame, and the secondary form/liner includes wires extending from its front and back frames; said front and secondary form/liners being joined by connecting said wires from said front form/liner back frame and said secondary form/liner front frame.

13. The crypt as described in claim 9 wherein each form/liner section has a length of about 3.75 feet.

14. The crypt form/liner as described in claim 8 wherein the first and second sides of the form/liner are a pleated.

15. The crypt form/liner as described in claim 8 including at least one rib which extends the circumference of said form/liner.

16. The crypt form/liner as described in claim 15 wherein said at least one connecting rod has a back end anchored in said a rib.

17. The crypt form/liner of claim 1 including at least one anchor cleat on an outer surface of said first side; said connecting rod being anchored in said anchor cleat.

18. The crypt form/liner as described in claim 8 wherein the form/liner is pre-cast.

19. The crypt form/liner of claim 1 including wires extending from said first side member of said front frame second tier for aid in securing a sealer plate to said crypt form/liner.

* * * * *